US009740124B2

(12) United States Patent
Sacripante et al.

(10) Patent No.: US 9,740,124 B2
(45) Date of Patent: Aug. 22, 2017

(54) TONER COMPOSITIONS AND PROCESSES

(71) Applicant: Xerox Corporation, Norwalk, CT (US)

(72) Inventors: Guerino G. Sacripante, Oakville (CA); Richard P. N. Veregin, Mississauga (CA); Kimberly D. Nosella, Mississauga (CA); Michael S. Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 30 days.

(21) Appl. No.: 14/720,877

(22) Filed: May 25, 2015

(65) Prior Publication Data

US 2016/0349641 A1 Dec. 1, 2016

(51) Int. Cl.
*G03G 9/087* (2006.01)

(52) U.S. Cl.
CPC ..... *G03G 9/08755* (2013.01)

(58) Field of Classification Search
CPC ..... G03G 9/093; G03G 9/08755
See application file for complete search history.

(56) References Cited

U.S. PATENT DOCUMENTS

| | | | | |
|---|---|---|---|---|
| 5,856,386 | A | 1/1999 | Sakai et al. | |
| 2011/0027714 | A1* | 2/2011 | McDougall | G03G 9/0821 430/108.11 |
| 2014/0255839 | A1* | 9/2014 | Taguchi | G03G 9/09733 430/105 |
| 2015/0234304 | A1* | 8/2015 | Nagata | G03G 9/08755 430/105 |

* cited by examiner

*Primary Examiner* — Peter Vajda
(74) *Attorney, Agent, or Firm* — Eugene O. Palazzo

(57) ABSTRACT

Disclosed are toner compositions that contain an amorphous polyester resin, a crystalline polyester resin, a colorant and a wax, and where the crystalline polyester resin is subjected to nucleation with a rosin acid or the salt of a rosin acid.

24 Claims, No Drawings

TONER COMPOSITIONS AND PROCESSES

The present disclosure is generally directed to toner compositions and processes thereof, and more specifically, to toners comprised of crystalline polyesters nucleated with a rosin acid or the salts thereof.

BACKGROUND

Certain polyester containing toner compositions are known, including where the polyesters selected are amorphous, crystalline or mixtures thereof. Thus, for example, in U.S. Pat. No. 7,858,285, the disclosure of which is totally incorporated herein by reference, there are disclosed emulsion/aggregation toners that include specific crystalline polyesters.

Toner compositions prepared by a number of emulsion/aggregation processes, and which toners may include certain polyesters are known as disclosed in U.S. Pat. Nos. 8,466,254; 7,736,832; 7,029,817; 6,830,860, and 5,593,807, the disclosures of each of these patents being totally incorporated herein by reference.

While these known toners may be suitable for their intended purposes, there remains a need for toners with acceptable and improved characteristics relating, for example, to fixing temperature latitudes and blocking temperatures of, for example, a blocking temperature of from about 50° C. to about 60° C. There is also a need for toners with excellent gloss and cohesion properties, acceptable minimum fixing temperatures, excellent hot and cold offset temperatures, and which toners possess desirable size diameters. Further, there is a need for toner compositions that do not substantially transfer or offset onto a xerographic fuser roller, referred to as hot or cold offset depending on whether the temperature is below the fixing temperature of the paper (cold offset), or whether the toner offsets onto a fuser roller at a temperature above the fixing temperature of the toner (hot offset).

Also, there is a need for toners that can be economically prepared and where low cost crystalline polyester resins are selected.

Moreover, there is a need for processes that enable the generation of enhanced crystallinity in polyesters.

Yet additionally, there is a need for polyester based toners with low fixing temperatures, such as from about 100° C. to about 130° C., and with a broad fusing latitude, such as from about 50° C. to about 90° C.

Another need resides in providing toners with improved blocking temperatures of, for example, from about 50° C. to about 55° C., from about 51° C. to about 54° C., and from about 53° C. to about 55° C.

Moreover, there is a need for toners with consistent small particle sizes of, for example, from about 1 to about 15 microns in average diameter, are of a suitable energy saving shape, have a narrow particle size GSD, and which toners include various core and shell structures.

These and other needs and advantages are achievable in embodiments with the processes and compositions disclosed herein.

SUMMARY

Disclosed is a toner composition comprised of an amorphous polyester resin, a crystalline polyester resin, a colorant and a wax, and wherein the crystalline polyester resin is subjected to nucleation with a rosin acid or a salt of a rosin acid.

Further disclosed herein is a toner composition comprised of a core of an amorphous polyester resin, a crystalline polyester, a wax and a colorant, and at least one shell encasing said core, and which shell is comprised of an amorphous polyester resin, and optionally a wax, wherein the crystalline polyester includes a nucleating salt of a rosin acid as represented by at least one of the following formulas/structures

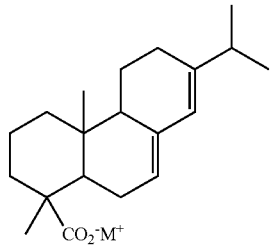

Abietic Acid

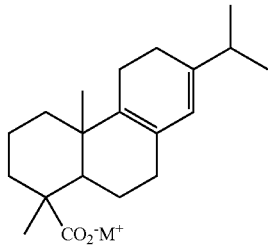

Palustric Acid

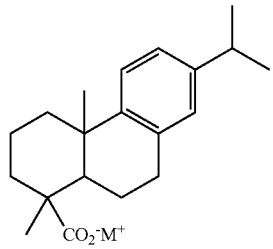

Dehydroabietic Acid

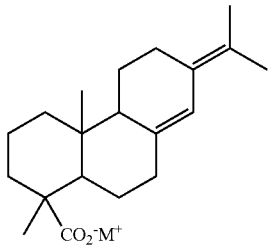

Neo-Abietic Acid

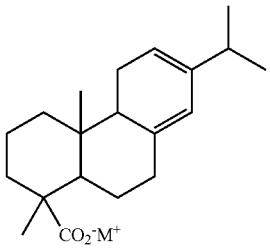

Levo-Pimaric Acid

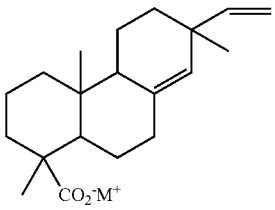

Pimaric Acid

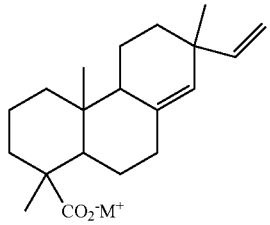

Sandaracopimaric Acid

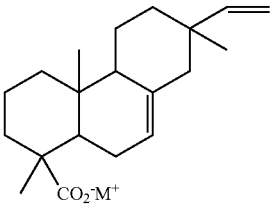

Iso-Pimaric Acid where M is a metal, $NH_4$ or hydrogen.

Moreover, there is illustrated herein a process comprising mixing an amorphous polyester resin, a crystalline polyester resin containing a salt of a rosin acid represented by at least one of the following formulas/structures

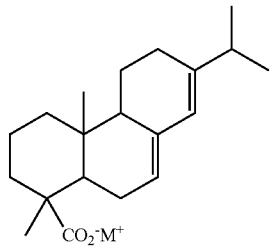

Abietic Acid

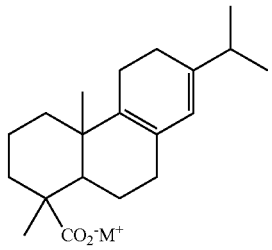

Palustric Acid

-continued

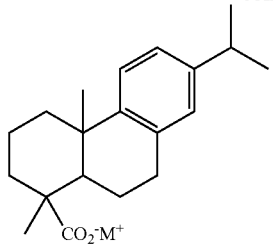

Dehydroabietic Acid

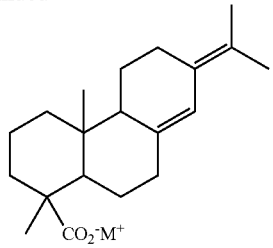

Neo-Abietic Acid

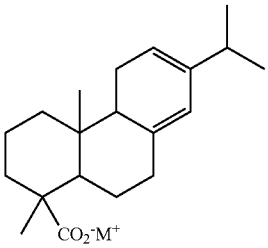

Levo-Pimaric Acid

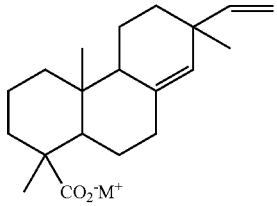

Pimaric Acid

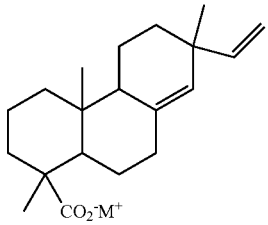

Sandaracopimaric Acid

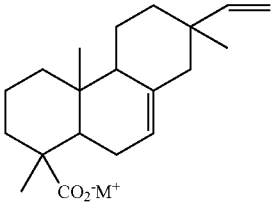

Iso-Pimaric Acid a colorant, and wax, and aggregating and coalescing to form toner particles, and wherein M is a hydrogen atom, $NH_4$ or a metal.

EMBODIMENTS

There are disclosed herein toner compositions that comprise nucleated crystalline polyester resins, amorphous polyester resins, colorants, waxes, and optional additives. The toner compositions illustrated herein, which can be prepared by emulsion/aggregation/coalescence processes, comprise crystalline polyesters that contain a rosin acid or the salts thereof as a nucleating agent.

In embodiments, the disclosed toners can be comprised of a core of, for example, an amorphous polyester, a crystalline polyester containing nucleating agent, wax, colorant, and additives and at least one shell thereover, such as from about 1 shell to about 5 shells, and more specifically, from about 1 shell to about 3 shells, and yet more specifically, from about 1 shell to about 2 shells.

Crystalline Polyesters

A number of crystalline polyesters can be selected for nucleation, inclusive of suitable known crystalline polyesters. Examples of crystalline polyesters that may be selected are poly(1,6-hexylene-1,12-dodecanoate), poly(1,2-propylene-diethylene-terephthalate), poly(ethylene-terephthalate), poly(propylene-terephthalate), poly(butylene-terephthalate), poly(pentylene-terephthalate), poly(hexalene-terephthalate), poly(heptylene-terephthalate), poly(octylene-terephthalate), poly(ethylene-sebacate), poly(propylene-sebacate), poly(butylene-sebacate), poly(nonylene-sebacate), poly(ethylene-adipate), poly(propylene-adipate), poly(butylene-adipate), poly(pentylene-adipate), poly(hexylene-adipate) poly(heptylene-adipate), poly(octylene-adipate), poly(ethylene-glutarate), poly(propylene-glutarate), poly(butylene-glutarate), poly(pentylene-glutarate), poly (hexalene-glutarate), poly(heptyl ene-glutarate), poly(octylene-glutarate), poly(ethylene-pimelate), poly(propylene-pimelate), poly(butylene-pimelate), poly(pentylene-pimelate), poly(hexalene-pimelate), poly(heptadene-pimelate), poly(1,2-propylene itaconate); poly(ethylene-succinate), poly(propylene-succinate), poly(butylene-succinate), poly(pentylene-succinate), poly(hexylene-succinate), poly(octylene-succinate), poly(decylene-decanoate), poly(ethylene-decanoate), poly(ethylene dodecanoate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and optionally mixtures thereof, and the like. A specific crystalline polyester selected for nucleation in accordance with the present disclosure is poly(1,6-hexylene-1,12-dodecanoate), which is generated by the reaction of dodecanedioc acid and 1,6-hexanediol, and more specifically, wherein the crystalline polyester is poly(1,6-hexylene-1,12-dodecanoate) of the following structure

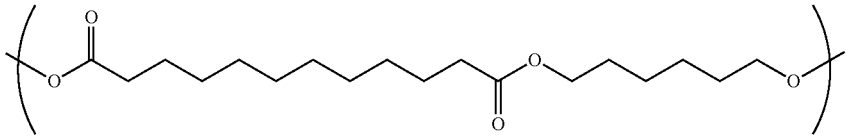

The crystalline resins can possess a number average molecular weight ($M_n$), as measured by gel permeation chromatography (GPC), of, for example, from about 1,000 to about 50,000, or from about 2,000 to about 25,000. The weight average molecular weight ($M_w$) of the crystalline polyester resins can be, for example, from about 2,000 to about 100,000, or from about 3,000 to about 80,000, as determined by GPC using polystyrene standards. The molecular weight distribution ($M_w/M_n$) of the crystalline polyester resin is, for example, from about 2 to about 6, and more specifically, from about 2 to about 4.

The disclosed crystalline polyester resins can be prepared by a polycondensation process by reacting suitable organic diols and suitable organic diacids in the presence of polycondensation catalysts. Generally, a stoichiometric equimolar ratio of organic diol and organic diacid is utilized, however, in some instances, wherein the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized varies, and can be selected in amounts, such as for example, from about 0.01 to about 1, or from about 0.1 to about 0.75 mole percent of the crystalline polyester resin.

Examples of organic diacids or diesters selected for the preparation of the crystalline polyester resins are as illustrated herein, and include fumaric, maleic, oxalic acid, succinic acid, glutaric acid, adipic acid, suberic acid, azelaic acid, sebacic acid, decanoic acid, 1,2-dodecanoic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid is selected in an amount of, for example, from about 48 to about 52 mole percent, of the crystalline polyester resin.

Examples of organic diols which include aliphatic diols selected in an amount of, for example, from about 1 to about 10, or from 3 to about 7 mole percent of the crystalline polyester resin that may be included in the reaction mixture or added thereto, and with from about 2 to about 36 carbon atoms, are 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, alkylene glycols like ethylene glycol or propylene glycol, and the like. The organic diols can be selected in various effective amounts, such as for example, from about 48 to about 52 mole percent of the crystalline polyester resin.

Amorphous Polyesters

A number of amorphous polyesters can be selected for the toners illustrated herein. Examples of amorphous polyesters include poly(propoxylated bisphenol co-fumarate), poly (ethoxylated bisphenol co-fumarate), poly(butyloxylated bisphenol co-fumarate, poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), and terpoly(propoxylated bisphenol A-terephthalate)-terpoly(propoxylated bisphenol A dodecenylsuccinate)-terpoly(propoxylated bisphenol A-fumarate). The amorphous resins are commercially available from Kao Corporation, DIC Chemicals and Reichhold Chemicals.

The amorphous polyester resins can possess, for example, a number average molecular weight ($M_n$), as measured by gel permeation chromatography (GPC) of, for example, from about 5,000 to about 100,000, or from about 5,000 to about 50,000. The weight average molecular weight (Mw) of the amorphouspolyester resins can be, for example, from about 2,000 to about 100,000, or from about 5,000 to about 80,000, as determined by GPC using polystyrene standards. The molecular weight distribution ($M_w/M_n$) of the amorphous polyester resin is, for example, from about 2 to about 6, and more specifically, from about 2 to about 4.

The disclosed amorphous polyester resins can be prepared by a polycondensation process which involves reacting suitable organic diols and suitable organic diacids in the presence of polycondensation catalysts. Generally, a stoichiometric equimolar ratio of an organic diol and an organic diacid is utilized, however, in some instances, wherein the boiling point of the organic diol is, for example, from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized varies, and can be selected in amounts as disclosed herein, and more specifically, for example, from about 0.01 to about 1, or from about 0.1 to about 0.75 mole percent of the amorphous polyester resin.

Examples of organic diacids or diesters selected for the preparation of the amorphous polyester resins are as illustrated herein, and include fumaric, maleic, oxalic acid, succinic acid, glutaric acid, adipic acid, suberic acid, azelaic acid, sebacic acid, decanoic acid, 1,2-dodecanoic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid is selected in an amount of, for example, from about 48 to about 52 mole percent, or from about 1 to about 10 mole percent of the amorphous polyester resin.

Examples of organic diols, which include aliphatic diols that are utilized for the preparation of the amorphous polyester resins, and that may be included in the reaction mixture or added thereto, and which diols can be selected in an amount of, for example, from about 45 to about 55, or from about 48 to about 52 mole percent of the amorphous polyester, and with from about 2 to about 36 carbon atoms, are 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, alkylene glycols like ethylene glycol or propylene glycol, propoxylated bisphenol A and ethoxylated bisphenol A. The organic diol is selected in an amount of, for example, from about 48 to about 52 mole percent of the amorphous polyester resin.

Nucleating Components

The crystalline polyester resins disclosed herein, and other known suitable crystalline polyesters are treated with a nucleating agent to increase the overall crystallization rate of the polyester resin. Crystallization rate refers to the temperature at which crystallization is occurring at a maximum rate ($T_c$ peak temperature) as measured by DSC (differential scanning calorimetry) and cooling at a defined rate from the polymer melt. More specifically, the crystallization rate is the change in delta H, or what has been referred to as the total crystallinity change. For example, the higher the $T_c$ peak temperature, the more effective the nucleating agent is in its ability at nucleating the polyester, thus affecting the crystallization rate of the resin. Thus, for example, the $T_c$ of a nucleated resin may increase in comparison to an untreated resin of from about 2° C. to about 10° C., that is, the $T_c$ may change from about 54° C. in an untreated polyester resin without a nucleating agent to about 58° C. in a nucleated crystalline polyester resin. Therefore, the $T_c$ of the crystalline polyester resin may increase from about 1 percent to about 20 percent after treatment with a nucleating agent in an amount, such as for example, from about 2 percent to about 15 percent, or from about 2 percent to about 10 percent.

The crystalline polyester resin may be treated with a nucleating agent during the process of generating the crystalline polyester resin emulsion, and where there is generated an emulsion of the crystalline polyester resin that includes a nucleating agent. In embodiments, the crystalline polyester resin is comprised of a nucleating agent with from about 0.001 percent by weight (or weight percent throughout) to about 10 percent by weight, from about 0.01 percent by weight to about 10 percent by weight, and more specifically, from about 0.5 percent by weight to about 5 percent by weight, and from about 0.1 to about 0.3 percent by weight based on the toner solids, or from about 1 percent by weight to about 3 percent by weight based on the crystalline polyester.

In further embodiments, the crystallinity of the polyester may be increased by adding the nucleating agent to a pre-toner mixture comprising the crystalline polyester resin emulsion and the amorphous resin emulsion. It is believed that adding the nucleating agent to the pre-toner mixture will cause the crystalline resin of the pre-toner mixture to become nucleated similar to the crystalline resin being nucleated in other embodiments disclosed herein.

The rosin acid salts nucleating component or agent is comprised of the salts of a rosin acid, such as dehydroabietic acid, and these rosin acid salts can be represented by at least one of the following formulas/structures

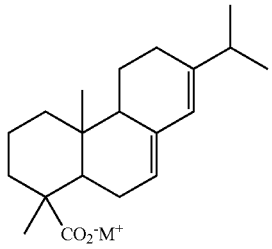

Abietic Acid

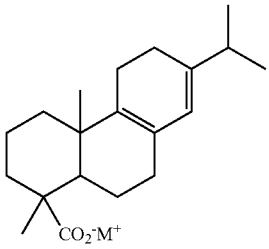

Palustric Acid

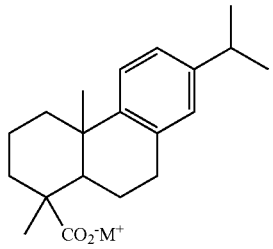

Dehydroabietic Acid

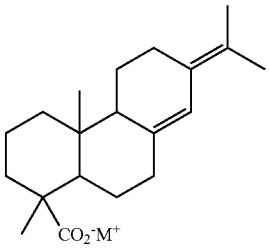

Neo-Abietic Acid

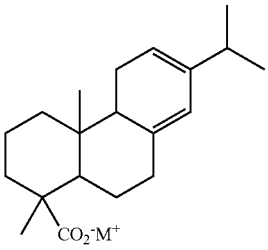

Levo-Pimaric Acid

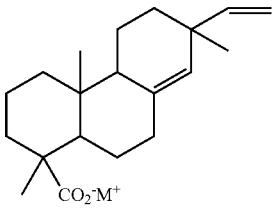

Pimaric Acid

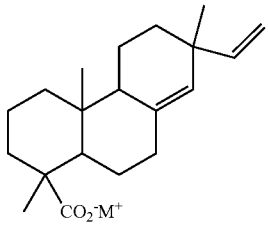

Sandaracopimaric Acid

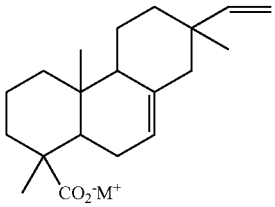

Iso-Pimaric Acid wherein M is a hydrogen atom, $NH_4$ or a metal, and which nucleating agents are available from Arakawa Chemicals, Pinova Incorporated Arizona Chemicals, and Eastman Chemicals.

Also, in embodiments the nucleating component, additive, or agent is comprised of the salts of a rosin acid, such as dehydroabietic acid, and which agent is, for example, represented by the following formula/structure

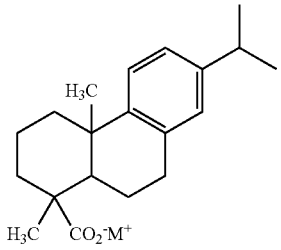

wherein M is as illustrated herein, and is, for example, a metal, a hydrogen atom, $NH_4$, and the like.

Metal salts of a rosin acid refers, for example, to the reaction product of a rosin acid with a suitable component, such as a metallic compound, and includes single salts of one or more rosin acids, mixed salts of one or more rosin acids and two or more metals, and mixtures of the aforementioned salts with one or more free acids, and wherein the salt content of the nucleating agent is, for example, from about 5 to about 20 to about 50 equivalent percent, based on the amount of the carboxyl group of the rosin acids. The metallic compounds for forming the rosin acid metallic salts are those which have a metal, such as sodium, potassium or magnesium, and are capable of reacting with the rosin acid.

Specific examples of M include hydrogen, ammonium ($NH_4$,) monovalent metallic ions, such as lithium, sodium, potassium, rubidium, and cesium; divalent metallic ions, such as beryllium, magnesium, calcium, strontium, barium and zinc; and trivalent metallic ions, such as aluminum. Usually the metallic ions are monovalent and divalent metallic ions, particularly sodium ion, potassium ion and magnesium ion.

The rosin acids are commercially available and can be obtained by disproportionating or hydrogenating natural rosins, such as gum rosin, tall oil rosin or wood rosin, and purifying them. The natural rosin generally contains two or more resin acids, such as pimaric acid, sandarachpimaric acid, parastric acid, isopimaric acid, abietic acid, dehydroabietic acid, neoabietic acid, dihydropimaric acid, dihydroabietic acid and tetrahydroabietic acid. These acids are typically obtained from tree sap, tree stumps or byproduct of the pulp and paper manufacturing process (Kraft).

More specifically, the rosin acids are wood rosins, which are obtained by harvesting pine tree stumps after they have remained in the ground for about 10 years, so that the bark and sapwood decay, and extrude the resinous material extract thus resulting in the rosin acids with similar formulas/structures as those illustrated herein, and where the various proportions of the individual acids may vary. For example, the major components of abietic acid and dehydroabietic amounts in the wood rosins are typically in excess of about 50 percent by weight, such as from about 55 to about 95 or from about 70 to about 90 percent by weight of the mixture solids. The amount of abietic acid present in the wood rosin acids mixture can be controlled by known purification methods, such as distillation, and where the amount subsequent to purification of this acid is believed to be from about 70 to about 80 percent by weight of the rosin acid mixture. Similarly, the amount of dehydroabietic acid can vary including when this acid is subjected to purification by known distillation methods, and which amount is, for example, believed to be from about 65 to about 85 percent by weight.

The nucleating agent can be present in the crystalline polyester or the toner compositions in various effective amounts as illustrated herein, such as for example, from about 0.01 to about 10 percent by weight, from about 0.1 to about 0.3 percent by weight of the toner solids, or from about 1 to about 3 percent by weight of the crystalline polyester resin.

Amorphous Polyesters

Examples of amorphous polyesters selected for the disclosed toner compositions include poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly (co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly (propoxylated bisphenol A co-fumarate)-copoly(propoxylated bisphenol A co-terephthalate), a terpoly(propoxylated bisphenol A co-fumarate)-terpoly(propoxylated bisphenol A co-terephthalate)-terpoly-(propoxylated bisphenol A co-dodecylsuccinate), mixtures thereof, and the like.

For the toner composition the amount of the amorphous polyester resin can be, for example, from about 70 to about 80 percent by weight, the amount of the polyester crystalline can be, for example, from about 5 to about 12 percent by weight, and the amounts of wax, colorant, and nucleating agent are as disclosed herein.

Waxes

Numerous suitable waxes may be selected for the toners illustrated herein, and which waxes can be included in the amorphous polyester resin, the crystalline polyester resin, or in the amorphous polyester resin and crystalline polyester mixture, in at least one shell, and in both the mixture and the at least one shell.

Examples of optional waxes included in the toner or on the toner surface include polyolefins, such as polypropylenes, polyethylenes, and the like, such as those commercially available from Allied Chemical and Baker Petrolite Corporation; wax emulsions available from Michaelman Inc. and the Daniels Products Company; EPOLENE N-15™ commercially available from Eastman Chemical Products, Inc.; VISCOL 550-P™, a low weight average molecular weight polypropylene available from Sanyo Kasei K.K., and similar materials. Examples of functionalized waxes that can be selected for the disclosed toners include amines, amides, for example, AQUA SUPERSLIP 6550™, SUPERSLIP 6530™ available from Micro Powder Inc.; fluorinated waxes, for example, POLYFLUO 190™, POLYFLUO 200™, POLYFLUO 523XF™, AQUA POLYFLUO 411™, AQUA POLYSILK 19™, POLYSILK 14™ available from Micro Powder Inc.; mixed fluorinated, amide waxes, for example, MICROSPERSION 19™ also available from Micro Powder Inc.; imides, esters, quaternary amines, carboxylic acids or acrylic polymer emulsion, for example, JONCRYL 74™, 89™, 130™, 537™, and 538™, all available from SC Johnson Wax; chlorinated polypropylenes and polyethylenes available from Allied Chemical and Petrolite Corporation, and from SC Johnson Wax. A number of these disclosed waxes can optionally be fractionated or distilled to provide specific cuts that meet viscosity and/or temperature criteria wherein the viscosity is, for example, about 10,000 cps, and the temperature is about 100° C.

In embodiments, the wax is in the form of a dispersion comprising, for example, a wax having a particle diameter of from about 100 nanometers to about 500 nanometers, or from about 100 nanometers to about 300 nanometers, water, and an anionic surfactant or a polymeric stabilizer, and optionally a nonionic surfactant. In embodiments, the wax comprises polyethylene wax particles, such as POLYWAX® 655, or POLYWAX® 725, POLYWAX® 850, POLYWAX® 500 (the POLYWAX® waxes being commercially available from Baker Petrolite) and, for example, fractionated/distilled waxes, which are distilled parts of commercial POLYWAX® 655 designated here as X1214, X1240, X1242, X1244, and the like, but are not limited to POLYWAX® 655 cuts. Waxes providing a specific cut that meet the viscosity/temperature criteria, wherein the upper limit of viscosity is about 10,000 cps and the temperature upper limit is about 100° C., can be used. These waxes can have a particle diameter in the range of from about 100 to about 500 nanometers, although not limited. Other wax examples include FT-100 waxes available from Shell (SMDA), and FNP0092 available from Nippon Seiro. The surfactant used to disperse the wax can be an anionic surfactant, such as, for example, NEOGEN RK® commercially available from Daiichi Kogyo Seiyaku or TAYCAPOWER® BN2060 commercially available from Tayca Corporation, or DOWFAX® available from DuPont.

The toner wax amount is in embodiments from about 0.1 to about 20, weight percent or percent by weight, from about 0.5 to about 15 weight percent, from about 1 to about 12 weight percent, from about 1 to about 10 weight percent, from about 4 to about 9 weight percent, from about 1 to about 5 weight percent, from about 1 to about 4 weight percent, and from about 1 to about 3 weight percent based on the toner solids.

Colorants

Examples of toner colorants include pigments, dyes, mixtures of pigments and dyes, mixtures of pigments, mixtures of dyes, and the like. In embodiments, the colorant comprises carbon black, magnetite, black, cyan, magenta, yellow, red, green, blue, brown, mixtures thereof.

The toner colorant can be selected, for example, from cyan, magenta, yellow, or black pigment dispersions of each color in an anionic surfactant, or optionally in a non-ionic surfactant to provide, for example, pigment particles having a volume average particle diameter size of, for example, from about 50 nanometers to about 300 nanometers, and from about 125 nanometers to about 200 nanometers. The surfactant used to disperse each colorant can be any number of known components such as, for example, an anionic surfactant like NEOGEN RK™. Known Ultimizer equipment can be used to provide the colorant dispersion, although media mill or other known processes can be utilized.

Toner colorant amounts vary, and can be, for example, from about 1 to about 50, from about 2 to about 40, from about 2 to about 30, from 1 to about 25, from 1 to about 18, from 1 to about 12, from 1 to about 6 weight percent, and from about 3 to about 10 percent by weight of total solids. When magnetite pigments are selected for the toner, the amounts thereof can be up to about 80 weight percent of solids like from about 40 to about 80 weight percent, or from about 50 to about 75 weight percent based on the total solids.

Specific toner colorants that may be selected include PALIOGEN VIOLET 5100™ and 5890™ (BASF), NORMANDY MAGENTA RD-2400™ (Paul Ulrich), PERMANENT VIOLET VT2645™ (Paul Ulrich), HELIOGEN GREEN L8730™ (BASF), ARGYLE GREEN XP-111-S™ (Paul Ulrich), BRILLIANT GREEN TONER GR 0991 ™ (Paul Ulrich), LITHOL SCARLET D3700™ (BASF), TOLUIDINE RED™ (Aldrich), Scarlet for THERMOPLAST NSD RED™ (Aldrich), LITHOL RUBINE TONER™ (Paul Ulrich), LITHOL SCARLET 4440™, NBD 3700™ (BASF), BON RED C™ (Dominion Color), ROYAL BRILLIANT RED RD-8192™ (Paul Ulrich), ORACET PINK RF™ (Ciba Geigy), PALIOGEN RED 3340™ and 3871K™ (BASF), LITHOL FAST SCARLET L4300™ (BASF), HELIOGEN BLUE D6840™, D7080™, K7090™, K6910™ and L7020™ (BASF), SUDAN BLUE OS™ (BASF), NEOPEN BLUE FF4012™ (BASF), PV FAST BLUE B2G01™ (American Hoechst), IRGALITE BLUE BCA™ (Ciba Geigy), PALIOGEN BLUE 6470™ (BASF), SUDAN II™, III™ and IV™ (Matheson, Coleman, Bell), SUDAN ORANGE™ (Aldrich), SUDAN ORANGE 220™ (BASF), PALIOGEN ORANGE 3040™ (BASF), ORTHO ORANGE OR 2673™ (Paul Ulrich), PALIOGEN YELLOW 152™ and 1560™ (BASF), LITHOL FAST YELLOW 0991K™ (BASF), PALIOTOL YELLOW 1840™ (BASF), NOVAPERM YELLOW FGL™ (Hoechst), PERMANERIT YELLOW YE 0305™ (Paul Ulrich), LUMOGEN YELLOW D0790™ (BASF), SUCOGELB 1250™ (BASF), SUCO-YELLOW D1355™ (BASF), SUCO FAST YELLOW D1165™, D1355™ and D1351™ (BASF), HOSTAPERM PINK E™ (Hoechst), FANAL PINK D4830™ (BASF), CINQUASIA MAGENTA™ (DuPont), PALIOGEN BLACK L9984™ (BASF), PIGMENT BLACK K801 ™ (BASF) and carbon blacks such as REGAL® 330 (Cabot), CARBON BLACK 5250™ and 5750™ (Columbian Chemicals), and the like, or mixtures thereof.

Colorant examples include pigments present in water based dispersions, such as those commercially available from Sun Chemical, such as for example, SUNSPERSE BHD 6011™ (Blue 15 Type), SUNSPERSE BHD 9312™ (Pigment Blue 15), SUNSPERSE BHD 6000™ (Pigment Blue 15:3 74160), SUNSPERSE GHD 9600™ and GHD 6004™ (Pigment Green 7 74260), SUNSPERSE QHD 6040™ (Pigment Red 122), SUNSPERSE RHD 9668™ (Pigment Red 185), SUNSPERSE RHD 9365™ and 9504™ (Pigment Red 57), SUNSPERSE YHD 6005™ (Pigment Yellow 83), FLEXIVERSE YFD 4249™ (Pigment Yellow 17), SUNSPERSE YHD 6020™ and 6045™ (Pigment Yellow 74), SUNSPERSE YHD 600™ and 9604™ (Pigment Yellow 14), FLEXIVERSE LFD 4343™ and LFD 9736™ (Pigment Black 7), mixtures thereof, and the like. Water-based colorant dispersions that may be selected for the toner compositions disclosed herein include those commercially available from Clariant, for example, HOSTAFINE Yellow GR™, HOSTAFINE Black T™ and Black TS™, HOSTAFINE Blue B2G™, HOSTAFINE Rubine F6B™ and magenta dry pigment, such as Toner Magenta 6BVP2213 and Toner Magenta EO2, which pigments can be dispersed in water and/or surfactants.

Examples of toner pigments selected and available in the wet cake or concentrated form containing water can be easily dispersed in water utilizing a homogenizer, or simply by stirring, ball milling, attrition, or media milling. In other instances, pigments are available only in a dry form, whereby a dispersion in water is effected by microfluidizing using, for example, a M-110 microfluidizer or an Ultimizer, and passing the pigment dispersion from about 1 to about 10 times through the microfluidizer chamber, or by sonication, such as using a Branson 700 sonicator, or a homogenizer, ball milling, attrition, or media milling with the optional addition of dispersing agents such as the aforementioned ionic or nonionic surfactants.

Further colorant examples are magnetites, such as Mobay magnetites MO8029™, MO8960™; Columbian magnetites, MAPICO BLACKS™ and surface treated magnetites; Pfizer magnetites CB4799 ™, CB5300 ™, CB5600 ™ MCX6369™; Bayer magnetites, BAYFERROX 8600™, 8610™; Northern Pigments magnetites, NP-604™, NP-608™; Magnox magnetites TMB-100™ or TMB-104™; and the like, or mixtures thereof.

Specific additional examples of pigments present in the toner in an amount of from 1 to about 40, from 1 to about 20, or from about 3 to about 10 weight percent of total solids include phthalocyanine HELIOGEN BLUE L6900™, D6840™, D7080™, D7020™, PYLAM OIL BLUE™, PYLAM OIL YELLOW™, PIGMENT BLUE 1 ™ available from Paul Ulrich & Company, Inc., PIGMENT VIOLET 1 ™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like, or mixtures thereof. Illustrative examples of cyans include copper tetra(octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK™ and cyan components, may also be selected as pigments. The pigment dispersion comprises pigment particles dispersed in an aqueous medium with an anionic dispersant/surfactant or a nonionic dispersant/surfactant, and wherein the dispersant/surfactant amount is in the range of from about 0.5 to about 10 percent.

Toner Compositions

The toner compositions illustrated herein can be prepared by emulsion aggregation/coalescence methods as described in a number of patents inclusive, for example, of U.S. Pat. Nos. 5,593,807; 5,290,654; 5,308,734; 5,370,963; 6,120,967; 6,628,102; 7,029,817; 7,736,832, and 8,466,254, the disclosures of each of these patents being totally incorporated herein by reference.

In embodiments, toner compositions may be prepared by any of the known emulsion-aggregation processes, such as a process that includes aggregating a mixture of an optional colorant, an optional wax and optional toner additives, with an emulsion comprising an amorphous polyester resin and a crystalline polyester resin that includes a nucleating agent, aggregating, and then coalescing the aggregated mixture.

The resin mixture emulsion may be prepared by the known phase inversion process, such as by dissolving the amorphous polyester resin, and the crystalline polyester resin with a nucleating agent in a suitable solvent, followed by the addition of water like deionized water containing a stabilizer, and optionally a surfactant.

Examples of optional suitable stabilizers that are selected for the toner processes illustrated herein include aqueous ammonium hydroxide, water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. The stabilizer is typically present in amounts of, for example, from about 0.1 percent to about 5 percent, such as from about 0.5 percent to about 3 percent, by weight of the colorant, wax and resin mixture. When such salts are added as a stabilizer, it may be desirable in embodiments that incompatible metal salts are not present in the composition.

Suitable dissolving solvents include alcohols, ketones, esters, ethers, chlorinated solvents, nitrogen containing solvents, and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. The resin mixture of the amorphous polyester and crystalline polyester, which crystalline polyester may be a nucleated crystalline polyester or where the crystalline polyester can be nucleated subsequent to the formation of an emulsion, can be dissolved in the solvent at elevated temperature of from about 40° C. to about 80° C., such as from about 50° C. to about 70° C. or from about 60° C. to about 65° C., with the desirable temperature being lower than the glass transition temperature of the wax and resin mixture of the amorphous polyester and nucleated crystalline polyester. In embodiments, the resin is dissolved in the solvent at elevated temperature, but below the boiling point of the solvent, such as from about 2° C. to about 15° C. or from about 5° C. to about 10° C. below the boiling point of the solvent.

Optionally, an additional stabilizer, such as a surfactant, may be added to the disclosed aqueous emulsion medium to afford additional stabilization to the resin mixture. Suitable surfactants include anionic, cationic and nonionic surfactants. In embodiments, the use of anionic and nonionic surfactants can additionally help stabilize the aggregation process in the presence of the coagulant, which otherwise could lead to aggregation instability.

Anionic surfactant examples include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN® brand of anionic surfactants. An example of a suitable anionic surfactant is NEOGEN® R-K available from Daiichi Kogyo Seiyaku Co. Ltd. (Japan), or TAYCAPOWER® BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL® and ALKAQUAT® available from Alkaril Chemical Company, SANISOL® (benzalkonium chloride), available from Kao Chemicals, and the like. An example of a suitable cationic surfactant is SANISOL® B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc Inc. as IGEPAL® CA-210, IGEPAL® CA-520, IGEPAL® CA-720, IGEPAL® CO-890, IGEPAL® CG-720, IGEPAL® CO-290, ANTAROX® 890 and ANTAROX® 897. An example of a suitable nonionic surfactant is ANTAROX® 897 available from Rhone-Poulenc Inc., which consists primarily of alkyl phenol ethoxylate.

Thus, there can be accomplished the blending and aggregation of the crystalline polyester resin emulsion containing a nucleating agent and the amorphous polyester resin emulsion, together in the presence of a colorant and optionally a wax with an aggregating agent, such as aluminum sulfate, at a pH of from about 3 to about 5, with the use of a homogenizer. The temperature may be slowly raised to about 40° C. to about 65° C., and held there for from about 3 hours to about 9 hours, such as about 6 hours, in order to provide, for example, from about 3 microns to about 5 microns diameter aggregated particles, followed by the addition of an amorphous polyester emulsion and optionally a wax emulsion to form a shell, and wherein the aggregated particle size increases to from about 5.1 microns to about 7 microns, followed by optionally adding more amorphous polyester emulsion for a second shell with optionally a wax emulsion. The final aggregated particles mixture can then be neutralized with an aqueous sodium hydroxide or buffer solution to a pH of, for example, from about a pH of 8 to about a pH of about 9. The aggregated particles are then heated from about 50° C. to about 90° C., causing the particles to be coalesced into toner composites with particle sizes in average volume diameter of, for example, from about 5 to about 7 microns, and with a shape factor of, for example, about 115 to about 130 as measured on the FPIA SYSMEX analyzer.

With further regard to the emulsion/aggregation/coalescence processes, following aggregation, the aggregates are coalesced as illustrated herein. Coalescence may be accomplished by heating the resulting aggregate mixture to a temperature that is about 5° C. to about 30° C. above the Tg of the amorphous resin. Generally, the aggregated mixture is heated to a temperature of about 50° C. to about 90° C. In embodiments, the aggregated mixture may also be stirred at from about 200 to about 750 revolutions per minute to coalesce the particles, and where coalescence may be accomplished over a period of, for example, from about 3 to about 9 hours.

Optionally, during coalescence the particle size of the toner particles may be controlled to a desired size by adjusting the pH of the mixture obtained. Generally, to control the particle size, the pH of the mixture can be adjusted to between about 5 to about 8 using a base such as, for example, sodium hydroxide.

After coalescence, the mixture may be cooled to room temperature, about 25° C., and the toner particles generated may be washed with water and then dried. Drying may be accomplished by any suitable method including freeze drying, which is usually accomplished at temperatures of about −80° C. for a period of about 72 hours.

Subsequent to aggregation and coalescence, the toner particles in embodiments have an average particle size diameter of from about 1 to about 15 microns, from about 4 to about 15 microns, and from about 6 to about 11 microns, such as about 7 microns as determined by a Coulter Counter. The volume geometric size distribution ($GSD_v$) of the toner particles may be in a range of from about 1.20 to about 1.35, and in embodiments less than about 1.25 as determined by a Coulter Counter.

Moreover, in embodiments of the present disclosure a pre-toner mixture can be prepared by combining a colorant, and optionally a wax and other toner components, stabilizer, surfactant, and both the nucleated crystalline polyester and amorphous polyester into an emulsion, or a plurality of the emulsions. In embodiments, the pH of the pre-toner mixture can be adjusted to from about 2.5 to about 4 by an acid such as, for example, acetic acid, nitric acid or the like. Additionally, in embodiments, the pre-toner mixture optionally may be homogenized. When the pre-toner mixture is homogenized, homogenization thereof may be accomplished by mixing at, for example, from about 600 to about 4,000 revolutions per minute with, for example, a TKA ULTRA TURRAX T50 probe homogenizer.

Following the preparation of the pre-toner mixture, an aggregate mixture is formed by adding an aggregating agent (coagulant) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature (Tg) of the emulsion resin. In some embodiments, the aggregating agent may be added in an amount of from about 0.05 to about 3 parts per hundred (pph) and from about 1 to about 10 pph with respect to the weight of toner. The aggregating agent may be added to the pre-toner mixture over a period of from about 0 to about 60 minutes. Aggregation may be accomplished with or without maintaining homogenization.

More specifically, in embodiments the toners of the present disclosure can be prepared by emulsion/aggregation/coalescence by (i) generating or providing a latex emulsion containing a mixture of an amorphous polyester resin, a crystalline polyester resin containing a nucleating agent, such as a rosin acid or a salt thereof, water, and surfactants, and generating or providing a colorant dispersion containing colorant, water, and an ionic surfactant, or a nonionic surfactant; (ii) blending the latex emulsions with the colorant dispersion and optional additives, such as a wax; (iii) adding to the resulting blend a coagulant comprising a polymetal ion coagulant, a metal ion coagulant, a polymetal halide coagulant, a metal halide coagulant, or a mixture thereof; (iv) aggregating by heating the resulting mixture below or about equal to the glass transition temperature (Tg) of the amorphous polyester resin to form a core; (v) optionally adding a further latex comprised of the amorphous polyester resin emulsion and optionally a wax emulsion resulting in a shell; (vi) introducing a sodium hydroxide solution to increase the pH of the mixture to about 4, followed by the addition of a sequestering agent to partially remove coagulant metal from the aggregated toner in a controlled manner; (vii) heating the resulting mixture of (vi) about equal to or about above the Tg of the amorphous resins mixture at a pH of from about 7 to about 9; (viii) retaining the heating until the fusion or coalescence of resins and colorant are initiated; (ix) changing the pH of the above (viii) mixture to arrive at a pH of from about 6 to about 7.5 thereby accelerating the fusion or the coalescence, and resulting in toner particles comprised of the amorphous polyester, the crystalline polyester containing a nucleating agent, wax, and colorant; and (x) optionally, isolating the toner.

To control aggregation and coalescence of the particles, the aggregating agent can, if desired, be metered into the resin containing mixture selected over a period of time. For example, the aggregating agent can be metered into the resin containing mixture over a period of, in one embodiment, at least from about 5 minutes to about 240 minutes, from about 5 to about 200 minutes, from about 10 to about 100 minutes, from about 15 to about 50 minutes, or from about 5 to about 30 minutes. The addition of the agent can also be performed while the mixture is maintained under stirred conditions of about 50 rpm (revolutions per minute) to about 1,000 rpm, from about 100 rpm to about 500 rpm, although the mixing speed can be outside of these ranges, and at a temperature that is below the glass transition temperature of the amorphous polyester resin of, for example, from about 10° C. to about 40° C., although the temperature can be outside of these ranges.

The particles formed can be permitted to aggregate until a predetermined desired particle size is obtained and where the particle size is monitored during the growth process until the desired or predetermined particle size is achieved. Composition samples can be removed during the growth process and analyzed, for example, with a Coulter Counter to determine and measure the average particle size. Aggregation can thus proceed by maintaining the elevated temperature, or by slowly raising the temperature to, for example, from about 35° C. to about 100° C. (although the temperature may be outside of this range), or from about 35° C. to about 45° C., and retaining the mixture resulting at this temperature for a time period of, for example, from about 0.5 hour to about 6 hours, and in embodiments of from about 1 hour to about 5 hours (although time periods outside of these ranges can be used) while maintaining stirring to provide the aggregated particles. Once the predetermined desired particle size is reached, the growth process is halted.

The growth and shaping of the particles following addition of the aggregation agent can be performed under any suitable conditions. For example, the growth and shaping can be conducted under conditions in which aggregation occurs separate from coalescence.

For separate aggregation and coalescence stages, the aggregation process can be conducted under shearing conditions at an elevated temperature, for example, of from about 40° C. to about 90° C., and in embodiments of from about 45° C. to about 80° C., which temperatures may be below the glass transition temperature of the amorphous polyester resin as illustrated herein.

Once the desired final size of the toner particles is achieved, the pH of the mixture can be adjusted with a base to a value in one embodiment of from about 6 to about 10, and in another embodiment of from about 6.2 to about 7, although a pH outside of these ranges can be used. The adjustment of the pH can be used to freeze, that is to stop toner particle growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts of from about 2 to about 25 percent by weight of the mixture, and in more specific embodiments from about 4 to about 10 percent by weight of the mixture, although amounts outside of these ranges can be used.

Following aggregation to the desired particle size, the particles can then be coalesced to the desired final shape, the coalescence being achieved by, for example, heating the mixture to any desired or effective temperature of from about 55° C. to about 100° C., from about 75° C. to about 90° C., from about 65° C. to about 75° C., or about 70° C., although temperatures outside of these ranges can be used, which can be below the melting point of the crystalline resin to prevent plasticization. Higher or lower temperatures may be used, it being understood that the temperature is a function of the resins and resin mixtures selected.

Coalescence can proceed and be performed over any desired or effective period of time, such as from about 0.1 hour to about 10 hours, from about 0.5 hour to about 8 hours, or no more than about 4 hours, although periods of time outside of these ranges can be used.

After coalescence, the above mixture can be cooled to room temperature, typically from about 20° C. to about 25° C. (although temperatures outside of this range can be used). The cooling can be rapid or slow, as desired. A suitable cooling method can include introducing cold water to a jacket around the reactor. After cooling, the toner particles can be optionally washed with water and then dried. Drying can be accomplished by any suitable method for drying including, for example, freeze drying resulting in toner particles possessing a relatively narrow particle size distribution with a lower number ratio geometric standard deviation (GSDn) of from about 1.15 to about 1.40, from about 1.18 to about 1.25, from about 1.20 to about 1.35, or from 1.25 to about 1.35.

The toner particles prepared in accordance with the present disclosure can, in embodiments, have a volume average diameter as disclosed herein (also referred to as "volume average particle diameter" or "D50v"), and more specifically, from about 1 to about 25, from about 1 to about 15, from about 1 to about 10, or from about 2 to about 5 microns. D50v, GSDv, and GSDn can be determined by using a measuring instrument, such as a Beckman Coulter Multisizer 3, operated in accordance with the manufacturer's instructions. Representative sampling can occur as follows: a small amount of toner sample, about 1 gram, can be obtained and filtered through a 25 micrometer screen, then placed in isotonic solution to obtain a concentration of about 10 percent, with the sample then being subjected to a Beckman Coulter Multisizer 3.

The disclosed toner particles can have a shape factor of from about 105 to about 170, and from about 110 to about 160, SF1*a, although the value can be outside of these ranges. Scanning electron microscopy (SEM) can be used to determine the shape factor analysis of the toners by SEM and image analysis (IA). The average particle shapes are quantified by employing the following shape factor (formula SF1*a=100d2/(4A)), where A is the area of the particle and d is its major axis. A perfectly circular or spherical particle has a shape factor of exactly 100. The shape factor SF1*a increases as the shape becomes more irregular or elongated in shape with a higher surface area.

Additionally, the toners disclosed herein possess low melting properties, thus these toners may be a low melt or ultra-low melt toner. Low melt toners display a melting point of from about 80° C. to about 130° C., and from about 90° C. to about 120° C. while ultra-low melt toners display a melting point of from about 50° C. to about 100° C., and from about 55° C. to about 90° C.

Toner Additives

Any suitable surface additives may be selected for the disclosed toner compositions. Examples of additives are surface treated fumed silicas, for example TS-530® obtainable from Cabosil Corporation, with an 8 nanometer particle size and a surface treatment of hexamethyldisilazane; NAX50® silica, obtained from DeGussa/Nippon Aerosil Corporation, coated with HMDS; DTMS® silica, obtained from Cabot Corporation, comprised of a fumed silica silicon dioxide core L90 coated with DTMS; H2050EP®, obtained from Wacker Chemie, coated with an amino functionalized organopolysiloxane; metal oxides such as $TiO_2$, for example MT-3103®, available from Tayca Corporation, with a 16 nanometer particle size and a surface treatment of decylsilane; SMT5103®, obtainable from Tayca Corporation, comprised of a crystalline titanium dioxide core MT500B coated with DTMS; P-25®, obtainable from Degussa Chemicals, with no surface treatment; alternate metal oxides such as aluminum oxide, and as a lubricating agent, for example, stearates or long chain alcohols, such as UNXLIN 700®, and the like. In general, silica is applied to the toner surface for toner flow, triboelectric enhancement, admix control, improved development and transfer stability, and higher toner blocking temperature. $TiO_2$ is applied for improved relative humidity (RH) stability, tribo control, and improved development and transfer stability.

The surface additives silicon oxides and titanium oxides, which should more specifically possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET surface area, are applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC.times.Size" (surface area coverage times the primary particle size of the additive in nanometers) for each of the silica and titania particles, or the like, for which all of the additives should, more specifically, have a total SAC.times.Size range of, for example, about 4,500 to about 7,200. The ratio of the silica to titania particles is generally from about 50 percent silica/50 percent titania to about 85 percent silica, 15 percent titania (on a weight percentage basis).

Calcium stearate and zinc stearate can also be selected as toner additives primarily providing for toner lubricating properties, developer conductivity and triboelectric charge enhancement, higher toner charge and charge stability by increasing the number of contacts between the toner and carrier particles. Examples of the stearates are SYNPRO®, Calcium Stearate 392A and SYNPRO®, Calcium Stearate NF Vegetable or Zinc Stearate-L. In embodiments, the toners contain from, for example, about 0.1 to about 5 weight percent titania, about 0.1 to about 8 weight percent silica, or from about 0.1 to about 4 weight percent calcium or zinc stearate.

Shell Formation

An optional at least one shell of an amorphous polyester resin and an optional wax resin can then be applied to the aggregated toner particles obtained in the form of a core. The shell resin or resins can be applied to the aggregated particles by any desired or effective method. For example, the shell resin can be in the form of an emulsion that includes a surfactant. The formed aggregated particles can be combined with the shell resin emulsion so that the shell resin forms a shell over from 80 to 100 percent of the formed aggregates.

Developer Compositions

Also encompassed by the present disclosure are developer compositions comprised of the toners illustrated herein and carrier particles. In embodiments, developer compositions comprise the disclosed toner particles mixed with carrier particles to form a two-component developer composition. In some embodiments, the toner concentration in the developer composition may range from about 1 weight percent to about 25 weight percent, such as from about 2 weight percent to about 15 weight percent, of the total weight of the developer composition.

Examples of carrier particles suitable for mixing with the disclosed toner compositions include those particles that are capable of triboelectrically obtaining a charge of opposite polarity to that of the toner particles, such as granular zircon, granular silicon, glass, steel, nickel, ferrites, iron ferrites, silicon dioxide, and the like. The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In applications in which the described toners are used with an image-developing device employing roll fusing, the carrier core may be at least partially coated with a polymethyl methacrylate (PMMA) polymer having a weight-average molecular weight of 300,000 to 350,000, for example, such as commercially available from Soken. PMMA is an electropositive polymer that will generally impart a negative charge on the toner by contact. The coating has, in embodiments, a coating weight of from about 0.1 weight percent to about 5 weight percent, or from about 0.5 weight percent to about 2 weight percent of the carrier, PMMA may optionally be copolymerized with any desired comonomer such that the resulting copolymer retains a suitable particle size. Suitable comonomers can include monoalkyl or dialkyl amines, such as dimethylaminoethyl methacrylates, diethylaminoethyl methacrylates, diisopropylaminoethyl methacrylates, tert-butyl amino ethyl methacrylates, and the like, and mixtures thereof. The carrier particles may be prepared by mixing the carrier core with from about 0.05 weight percent to about 10 weight percent of polymer, such as from about 0.05 weight percent to about 3 weight percent of polymer, based on the weight of the coated carrier particles, until the polymer coating adheres to the carrier core by mechanical impaction and/or electrostatic attraction. Various effective suitable means can be used to apply the polymer to the surface of the carrier core particles, for example, cascade-roll mixing, tumbling, milling, shaking, electrostatic powder-cloud spraying, fluidized bed, electrostatic disc processing, and with an electrostatic curtain. The mixture of carrier core particles and polymer is then heated to melt and fuse the polymer to the carrier core particles. The coated carrier particles are then cooled and classified to a desired particle size.

Carrier particles can be mixed with toner particles in any suitable combination in embodiments. In some embodiments, for example, about 1 to about 5 parts by weight of toner particles are mixed with from about 10 to about 300 parts by weight of the toner particles.

The toner compositions disclosed may also include known charge additives in effective amounts, such as from about 0.1 to about 5 weight percent, such as alkyl pyridinium halides, bisulfates, the charge control additives of U.S. Pat. Nos. 3,944,493; 4,007,293; 4,079,014; 4,394,430, and 4,560,635, the disclosures of which are totally incorporated herein by reference, and the like. Surface additives that can be added to the toner compositions after washing or drying include, for example, those disclosed herein, like metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000, 3,720,617, 3,655,374, and 3,983,045, the disclosures of which are totally incorporated herein by reference. Examples of specific suitable additives include zinc stearate and AEROSIL R972®, available from Degussa, in amounts of from about 0.1 to about 2 percent which can be added during the aggregation process or blended into the formed toner product.

The present disclosure provides a method of developing a latent xerographic image comprising applying the toner composition described herein to a photoconductor, transferring the developed image to a suitable substrate like paper, and fusing the toner composition to the substrate by exposing the toner composition to heat and pressure.

Specific embodiments will now be described in detail. These examples are intended to be illustrative, and are not limited to the materials, conditions, or process parameters set forth therein. All parts are percentages by solid weight unless otherwise indicated, and the particle sizes were measured with a Multisizer 3® Coulter Counter available from Beckman Coulter.

For the Examples that follow, cohesion refers to the percent of toner that does not flow through sieve(s) after the toner was maintained in an oven at certain temperatures, such as 51° C. The temperature can then be increased from 51° C. to 52° C., and 53° C., and the like, and the cohesion values can be measured at each of these temperatures. The cohesion value (at each temperature) was then plotted versus temperature, and the temperature at which the cohesion is 20 percent was determined to be the blocking temperature.

More specifically, 20 grams of toner, from about 6 to about 11 microns in average diameter, were blended with about 2 to about 4 percent of surface additives, such as silica and/or titania, and sieve blended through a 106 micron screen. A 10 gram sample of the toner was placed into an aluminum weighing pan, and this sample was conditioned in a bench top environmental chamber at various temperatures (51° C., 52° C., 53° C., 54° C., 55° C., 56° C., 57° C.), and 50 percent RH for 24 hours. After 24 hours, the toner samples were removed and cooled in air for 30 minutes prior to the measurements.

After cooling, each of the toner samples were transferred from the weighing pan to a 1,000 micron sieve at the top of the sieve stack (top (A) 1,000 microns, bottom (B) 106 microns). The difference in weight was measured, which difference provides the toner weight (m) transferred to the sieve stack. The sieve stack containing the toner sample was loaded into the holder of a Hosokawa flow tester apparatus. The tester is operated for 90 seconds with a 1 millimeter amplitude vibration. Once the flow tester times out, the weight of toner remaining on each sieve was measured, and the percent heat cohesion was calculated using 100*(A+B)/m, where A is the mass of toner remaining on the 1,000 micron screen, B is the mass of toner remaining on the 106 micron screen, and m is the total mass of the toner placed on top of the set of stacked screens. The cohesion obtained at each temperature was then plotted against the temperature, and the point at which 20 percent cohesion was interpolated (or extrapolated) from the plot corresponded to the blocking temperature.

EXAMPLE I

An emulsion comprised of 99 percent by weight of the crystalline polyester resin, poly(1,6-hexylene-1,12 dodecanoate) and 1 percent by weight of the potassium salt of dehydroabietic acid (rosin).

There was prepared a latex emulsion by first adding 60 grams of deionized water (DI) to a 125 milliliter plastic bottle followed by heating in a water bath to 70° C. (degrees Centigrade).

Subsequently, in a second 125 milliliter plastic bottle there were added 20 grams of the crystalline polyester poly(1,6-hexylene-1,12-dodecanoate) (C10:C6), 20 grams of methyl ethyl ketone, 2 grams of isopropanol, and 22 grams of the potassium hydroxide neutralized rosin (dehydroabietic acid) nucleating agent obtained from Arakawa as DPR, where the metal M is potassium in the dehydroabietic acid formula/structure illustrated herein. This bottle was then heated in a water bath to 65° C. while being stirred with a magnetic stir bar. After the aforementioned nucleated crystalline resin was dissolved, 3.75 grams of 10 percent ammonium hydroxide were added to the dissolved mixture.

To the resulting mixture there was added the above prepared 60 grams of heated DI water, and the formed latex was poured into a recrystallation dish that contained DI water, and the above solvents of methyl ethyl ketone and isopropanol were substantially eliminated while mixing overnight, about 25 hours, in a fume hood. The resulting latex was then screened through a 20 micron sieve and the percent solids and particle size were determined by a moisture analyzer and a Nanotrac, respectively; particle size 370 nanometers and percent solids of 3.71.

EXAMPLE II

An emulsion comprised of 99 percent by weight of the crystalline polyester resin, poly (1,6-hexylene-1,12 dodecanoate), and 1 percent by weight of the potassium salt of dehydroabietic acid (rosin).

The process of Example I was repeated except that 3.87 grams of 10 percent ammonium hydroxide was selected, and there resulted a measured particle size of 201 nanometers and a solids content of 7.59 percent.

COMPARATIVE EXAMPLE 1

There was prepared a black toner composition that includes a crystalline polyester without nucleating agent as follows.

In a glass kettle reactor, there were added and mixed 110 grams of the emulsion (38.9 percent solids) comprised of the amorphous polyester FXC42, obtained from Kao Corporation, and 109 grams of the emulsion (38.95 percent solids) comprised of the amorphous polyester FXC56, obtained from Kao Corporation. These amorphous polyester resins, obtained from Kao Corporation, are believed to be comprised of terpoly-(propoxylated bisphenol A-terephthalate) terpoly-(propoxylated bisphenol A-dodecenylsuccinate) terpoly-(propoxylated bisphenol A fumarate). To this were added 100 grams of the crystalline polyester poly(1,6-hexylene-1,12-dodecanoate) emulsion (9 percent solids and no nucleating agent), 7.5 grams of a wax emulsion, 29.9 percent solids, comprised of polypropylene obtained as OMNOVA D1509®, obtained from IGI Chemicals, 9 grams of the cyan PIGMENT BLUE 15:3® dispersion (16.4 percent solids), available from Sun Chemicals, 70 grams of carbon black pigment dispersion (16.1 percent solids, NIPEX35®, obtained from Degussa AG), 0.4 gram of the surfactant (DOWFAX®) and 379 grams of DI water. The slurry resulting was adjusted to a pH of 4.5 with 0.3M nitric acid.

Then, 2.7 grams of aluminum sulfate mixed with 33 grams of DI water were added to the above obtained slurry with homogenization at 3,000 to 4,000 rpm (revolutions per minute). The reactor was set to 260 rpm and then heated to 47° C. to aggregate the particles resulting. When the particle size was at 4.5 μm (microns), a shell coating was added to the reactor, and which shell contained 36 grams of the amorphous polyester emulsion (FXC42), 36 grams of the amorphous polyester emulsion (FXC56), and 15 grams of polypropylene wax, followed by adjusting the pH to 6 with 0.3M nitric acid. When the particle size was 4.8 to 5.0 μm (microns), a second shell coating was added of 36 grams of the amorphous polyester emulsion (FXC42), 36 grams of the amorphous polyester emulsion (FXC56), and then the pH was adjusted to 6 with 0.3M nitric acid.

Subsequently, the above resulting reaction mixture was further heated to 52° C. When the toner particle size (average volume diameter throughout) was 5.6 to 6.5 microns, as measured with a Multisizer 3® Coulter Counter, available from Beckman Coulter, freezing begins, and where the pH of the slurry was adjusted to 4.5 with a 4 percent NaOH solution. The reactor rpm was then decreased to 240 rpm, followed by the addition of 5.77 grams of a chelating agent (VERSENE 100®) and more NaOH solution until the pH was 7.8. The reactor temperature was then increased to 85° C., and the pH of the slurry was maintained at 7.8 or greater. Once at the coalescence temperature, the slurry pH was reduced to 7.2 with an acetic acid/sodium acetate (HAc/NaAc) buffer solution (pH 5.7) for assisting coalescence, and where the slurry solids were coalesced for 240 minutes resulting in a particle circularity of 0.970 to 0.980 as measured by a Flow Particle Image Analysis (FPIA) instrument. The slurry was then quench cooled in 360 grams of DI ice. The final toner particle size was 6.28 microns with a GSDv of 1.21, a GSDn of 1.23 and a circularity of 0.971. The toner was then washed and freeze-dried, and was comprised of 77.8 percent (percent=weight percent or percent by weight) of the amorphous resin, 6.2 percent of the crystalline polyester resin, 9 percent of wax, 1 percent of the cyan pigment, and 6 percent of the carbon black pigment.

EXAMPLE III

There was prepared a black toner composition that included a crystalline polyester with 1 weight percent of nucleating agent and 99 weight percent of the crystalline polyester as follows.

In a 2 liter glass kettle reactor, there were mixed 96 grams of the amorphous polyester emulsion (FXC42), 95 grams of the amorphous polyester emulsion (FXC56), 275 grams of poly(1,6-hexylene-1,12-dodecanoate) polyester emulsion with 1 weight percent of the potassium hydroxide neutralized dehydroabietic acid (rosin) nucleating agent (3.71 percent by weight solids), 45 grams of polypropylene wax, 9 grams of the above cyan pigment PIGMENT BLUE 15:3® dispersion, 69 grams of NIPEX35® carbon black pigment, 0.4 gram of the surfactant DOWFAX® and 217 grams of DI. The resulting slurry was then adjusted to a pH of 4.5 with 0.3M nitric acid.

Then 2.7 grams of aluminum sulfate mixed with 33 grams of DI water were added to the above prepared slurry under homogenization at 3,000 to 4,000 rpm. The reactor was then set to 260 rpm and heated to 47° C. to aggregate the particles. When the diameter size of particles was at 4.7 to 5 μm (microns), a shell coating was applied, and which coating contained of 74 grams of the amorphous polyester emulsion (FXC42), and 73 grams of the amorphous polyester emulsion (FXC56), and where the pH was adjusted to 6 with 0.3M nitric acid.

The reaction mixture resulting was subsequently further heated to 52° C., and where when the toner particle size was 5.6 to 6.5 microns, and freezing was initiated with the pH of the slurry being adjusted to 4.5 using a 4 percent NaOH solution and the reactor rpm was decreased to 240 followed by the addition of 5.77 grams of the chelating agent (VERSENE 100®) and further NaOH solution until a pH of 7.8 results. The reactor temperature was then increased to 85° C., and the pH of the slurry was maintained at 7.8 or greater until 85° C.

Once at the above 85° C. coalescence temperature, the slurry pH was reduced to 7 using an acetic acid/sodium acetate (HAc/NaAc) buffer solution (pH 5.7), and was coalesced for 4 hours where the particle circularity was 0.970 to 0.980 as measured by the Flow Particle Image Analysis (FPIA) instrument. The slurry obtained was then quench cooled in 360 grams of DI ice and there resulted toner particles with a final particle size of 6.34 microns, a GSDv volume of 1.22, a GSD number of 1.21, and a circularity of 0.978. The toner was then washed and freeze-dried, and was comprised of 77.8 percent (percent=weight percent throughout) of the amorphous polyester resin, 6.14 percent of the crystalline polyester resin, 0.06 percent of the potassium salt of dehydroabietic acid (rosin), 9 percent of wax, 1 percent of the above cyan pigment, and 6 percent of the carbon black pigment.

EXAMPLE IV

In a 2 liter glass kettle reactor, there were mixed 94 grams of the amorphous polyester emulsion (FXC42), 93 grams of the amorphous polyester emulsion (FXC56), 135 grams of the 010:06, crystalline polyester emulsion with 0.22 gram of the potassium hydroxide neutralized rosin nucleating agent (7.59 percent solids), 45 grams of polypropylene wax, 9 grams of the above cyan pigment, 69 grams of the carbon black NIPEX 35™ pigment, 0.4 gram of the surfactant DOWFAX® and 350 grams of DI water. The resulting slurry was pH adjusted to 4.5 using 0.3M nitric acid.

Then 2.7 grams of aluminum sulfate mixed with 33 grams of DI water were added to the above obtained slurry under homogenization at 3,000 to 4,000 rpm. When the particle size diameter was at 4.7 to 5 μm a shell coating was added of 74 grams of the amorphous polyester emulsion (FXC42), and 73 grams of the amorphous polyester emulsion (FXC56), and the pH was adjusted to 6 using 0.3M nitric acid. The reaction mixture resulting was then further heated to 52° C. When the toner particle size diameter was 5.6 to 6.5 microns, freezing (particles retained at a certain size diameter) begins with the pH of the slurry being adjusted to 4.5 using a 4 percent NaOH solution.

The reactor rpm was then decreased to 240° C. followed by the addition of 5.77 grams of the chelating agent (VERSENE 100®) and more NaOH solution until the pH was 7.8. The reactor temperature was then increased to 85° C., and the pH of the resulting slurry was maintained at 7.8 or greater. Once the coalescence temperature of 85° C. to 90° C. was achieved, the slurry pH was reduced to 7.2 with an acetic acid/sodium acetate (HAc/NaAc) buffer solution (pH 5.7), followed by coalescing for 90 minutes where the particle circularity was 0.970 to 0.980 as measured by the Flow Particle Image Analysis (FPIA) instrument. The resulting slurry was then quench cooled in 360 grams of DI ice. The final toner particle size was 6.48 microns with a GSDv 1.22, a GSDn of 1.21, and a circularity of 0.983. The toner was then washed and freeze dried and was comprised of a core of 77.8 percent (weight percent throughout) of amorphous polyester resin, 6.14 percent of crystalline polyester resin, 0.06 percent potassium salt of dehydroabietic acid (rosin), 9 percent wax, 1 percent of the above cyan pigment, and 6 percent of carbon black pigment, and the above shell encasing the core.

The above prepared toners and comparative toners were tested as indicated herein and there resulted the following.

| EXAMPLE NUMBER | COALESCENCE TIME IN MINUTES | CRYSTALLINE POLYESTER RESIN | COHESION PERCENT 51° C. | 52° C. | 53° C. | BLOCKING TEMPERATURE |
|---|---|---|---|---|---|---|
| COMPARATIVE EXAMPLE 1 | 242 | C10:6 CONTROL | 96.8, 81.9 | 91.2, 96 | | 49.8 |
| EXAMPLE III | 242 | C10:6; 1% ROSIN | 7.4, 8.2 | 11.4, 12.3 | 21.3, 18.4 | 52.5 |
| EXAMPLE IV | 80 | C10:6; 1% ROSIN ACID | 88.2, 7.8 | 8.0, 8.6 | 9.9, 12.5 | 53 |

The above Example III and Example IV toners possessed higher and improved blocking temperatures. For the above cyan toner containing the crystalline polyester that includes a nucleating agent, the blocking temperature was excellent and was increased, see the above data, to about 52.5° C., that is 2.7° C. higher for the Example III toner, and for the Example IV toner the blocking temperature was increased by 3.2° C. to 53° C.

Gloss fusing parameters, such as MFT (Minimum Fixing Temperature) and Hot offset of the above prepared toners, were collected with samples of the particles fused onto a Color Xpressions Select (90 gms) using a Xerox Corporation in-house fusing fixture similar to the Xerox 700 fusing printer. The fixing latitude is equal to the Hot-Offset–(minus) the MFT.

The control or comparative toners utilized were the Xerox Corporation 700 Digital Color Press cyan toner and the Xerox Docucolor 2240 cyan toner.

| | XEROX 2240 CYAN TONER | XEROX 700 CYAN TONER | EXAMPLE III |
|---|---|---|---|
| GLOSS @ 185° C. | 66.6 | 65.4 | 62.4 |
| HOT @ 220 MM/S | >210 | 205 | 210 |
| COLD OFFSET | 140 | 127 | 113 |
| FIX LATITUDE$_{(CA-80/COT)}$ | 67/>72 | 73/78 | 89/94 |
| T($G_{50}$) | 158 | 143 | 152 |
| MFT$_{(CA-80)}$ | 138 | 122 | 116 |

For the cyan toner of Example III the print gloss was 185° C. and the temperature at Gloss$_{50}$ was similar or within the values of both control toners. For the cyan toner of Example III the Hot-Offset temperature was similar to or higher than the control toners, the fixing latitude was higher and the minimum fixing temperature was lower for the cyan toner of Example III versus both of the Xerox Corporation control toners.

EXAMPLE V

There was prepared a crystalline polyester resin that included 1 weight percent of nucleating agent as follows.

In a 2 liter beaker, about 547.11 grams of deionized water was heated to about 80° C. Also, in a 500 milliliter beaker, about 305 grams of acetone, about 27.88 grams of the crystalline polyester resin, poly(1,6-hexylene-1,12-dodecanoate), (C10:C6) generated from the reaction of dodecanedioc acid, and 1,6-hexane diol, and 21 grams of the above potassium hydroxide neutralized rosin were stirred together and heated to about 55° C. to dissolve the resin and nucleating agent in the acetone.

The resulting acetone/resin mixture was added dropwise via a Pasteur pipette to the above heated 80° C. deionized water. The acetone was removed by distillation. Any particles over 20 microns were removed by screening through a 20 micron sieve followed by centrifuging the remaining emulsion at about 3,000 rpm for about 3 minutes to further isolate and remove larger particles exceeding 15 to 20 microns resulting in the above crystalline polyester resin that included 1 weight percent of potassium hydroxide nucleating agent.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A toner composition comprised of an amorphous polyester resin, a crystalline polyester resin, a colorant and a wax, and wherein said crystalline polyester resin includes a rosin acid or a salt of a rosin and wherein said crystalline polyester is poly1,2-propylene-diethylene) terephthalate, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, poly(nonylene-sebacate), polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(1,2-propylene itaconate); poly(ethylene-succinate), poly(propylene-succinate), poly(butylene-succinate), poly(pentylene-succinate), poly (hexylene-succinate), poly(octylene-succinate), poly(decylene-decanoate), poly(ethylene-decanoate), poly(ethylene dodecanoate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), poly(1,6-hexylene-1,12-dodecanoate) or optionally mixtures thereof, and wherein said salt of a rosin acid is represented by one of the following formulas/structures wherein M is a hydrogen atom, $NH_4$ or a metal

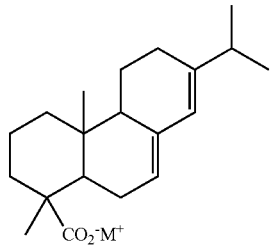

Abietic Acid

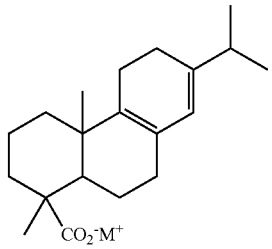

Palustric Acid

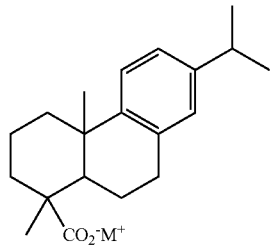

Dehydroabietic Acid

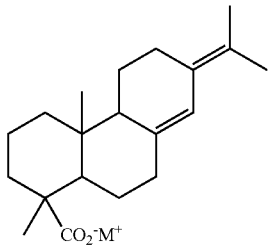

Neo-Abietic Acid

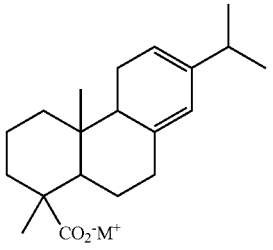

Levo-Pimaric Acid

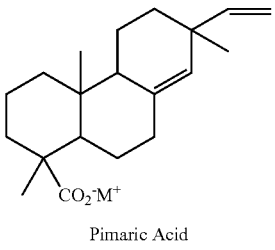

Pimaric Acid

-continued

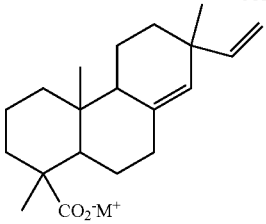

Sandaracopimaric Acid

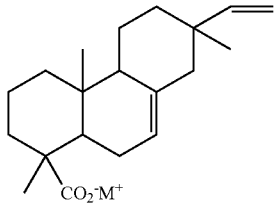

Iso-Pimaric Acid

2. A toner in accordance with claim 1 wherein said salt of a rosin acid is the potassium salt of dehydroabietic acid.

3. A toner in accordance with claim 1 wherein said M is sodium, potassium, lithium, or magnesium.

4. A toner in accordance with claim 1 wherein M is sodium, or potassium.

5. A toner in accordance with claim 1 wherein said salt of a rosin acid is the potassium hydroxide neutralized rosin, and said crystalline polyester is poly(1,6-hexylene-1,12-dodecanoate).

6. A toner in accordance with claim 1 wherein said rosin acid is selected from the group consisting of natural rosins of gum rosin, tall oil rosin or wood rosin, a disproportionated rosin acid, a hydrogenated rosin acid, a dehydroabietic acid pimaric acid, a sandarachpimaric acid, a parastric acid, an isopimaric acid, an abietic acid, a dehydroabietic acid, a neoabietic acid, a dihydropimaric acid, a dihydroabietic acid and a tetrahydroabietic acid.

7. A toner in accordance with claim 1 wherein the amorphous polyester is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly (propoxylated bisphenol A co-terephthalate), a terpoly (propoxylated bisphenol A co-dodecylsuccinate)-terpoly (propoxylated bisphenol A co-terephthalate)-terpoly-(propoxylated bisphenol A co-dodecylsuccinate), and mixtures thereof.

8. A toner in accordance with claim 1 wherein the crystalline polyester is poly(1,6-hexylene-1,12-dodecanoate).

9. A toner in accordance with claim 1 wherein the amorphous polyester is a copoly (propoxylated bisphenol A co-fumarate)-copoly (propoxylated bisphenol A co-terephthalate), or a terpoly (propoxylated bisphenol A co-dodecylsuccinate)-terpoly (propoxylated bisphenol A co-terephthalate)-terpoly-(propoxylated bisphenol A co-dodecylsuccinate), and the crystalline polyester is poly (1,6-hexylene-1,12-dodecanoate).

10. A toner in accordance with claim wherein the crystalline polyester is poly(1,2-propylene-diethylene) terephthalate, poly(decylene-decanoate), poly(ethylene-decanoate), poly(ethylene dodecanoate), poly(nonylene-decanoate), copoly(ethylene-fumarate)-copoly(ethylene-sebacate), copoly(ethylene-fumarate)-copoly(ethylene-decanoate), or copoly(ethylene-fumarate)-copoly(ethylene-dodecanoate).

11. A toner in accordance with claim 1 wherein said wax is a polyolefin.

12. A toner in accordance with claim 1 wherein said wax is polyethylene, polypropylene, or mixtures thereof.

13. A toner in accordance to claim 1 wherein said wax is present in an amount of from about 1 to about 10 weight percent of the solids.

14. A toner in accordance with claim 1 wherein said wax is contained in said amorphous polyester and said crystalline polyester mixture, and on the toner surface.

15. A toner in accordance to claim 1 wherein said colorant is a pigment.

16. A toner in accordance with claim 1 wherein said colorant is selected from at least one of carbon black, cyan, magenta, yellow and mixtures thereof.

17. A toner in accordance with claim 1 wherein said toner is comprised of a core of said amorphous polyester resin, said crystalline polyester resin, said salt of a rosin acid, said wax and said colorant, and at least one shell comprised of said amorphous polyester resin, said wax, and said colorant.

18. A toner in accordance with claim 1 and with a blocking temperature of from about 50° C. to about 55° C.

19. A toner composition comprised of a core of an amorphous polyester resin, a crystalline polyester, a wax and a colorant, and at least one shell encasing said core, and which shell is comprised of an amorphous polyester resin, and optionally a wax, wherein the crystalline polyester includes a nucleating salt of a rosin acid as represented by at least one of the following formula/structures

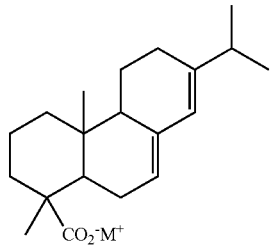

Abietic Acid

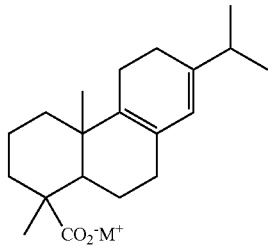

Palustric Acid

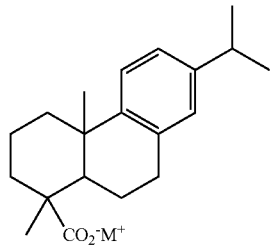

Dehydroabietic Acid

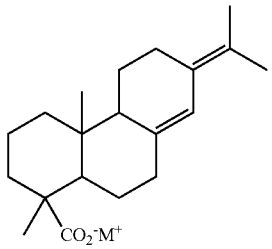

Neo-Abietic Acid

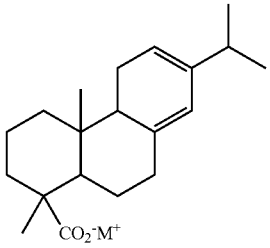

Levo-Pimaric Acid

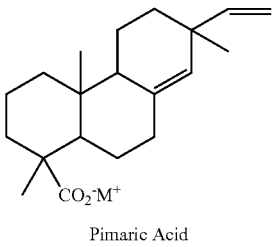

Pimaric Acid

-continued

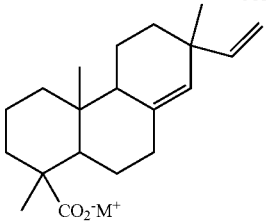

Sandaracopimaric Acid

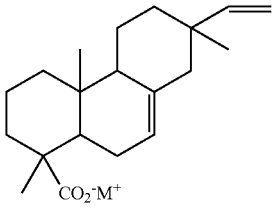

Iso-Pimaric Acid where M is a metal, $NH_4$ or hydrogen.

20. A toner composition in accordance with claim 19 wherein the amorphous polyester resin is a copoly(propoxylated bisphenol A co-fumarate)-copoly(propoxylated bisphenol A co-terephthalate), a terpoly(propoxylated bisphenol A co-dodecylsuccinate)-terpoly(propoxylated bisphenol A co-terephthalate)-terpoly-(propoxylated bisphenol A co-dodecylsuccinate); the crystalline polyester is poly(1,6-hexylene-1,12-dodecanoate); the colorant is a pigment, and the salt of the rosin acid is a potassium salt of dehydroabietic acid.

21. A toner composition in accordance with claim 19 wherein said toner has a blocking temperature of from about 51° C. to about 54° C., and which toner is prepared by emulsion/aggregation/coalescence processes.

22. A toner composition in accordance with claim 19 wherein said amorphous resin is present in an amount of from about 70 weight percent to about 80 weight percent, said nucleated crystalline polyester resin is present in an amount of from about 5 weight percent to about 12 weight percent, said wax is present in an amount of from about 4 weight percent to about 9 weight percent, said colorant is present in an amount of from about 3 weight percent to about 10 weight percent of the solids, and said rosin salt is present in an amount of from about 1 to about 3 weight percent of the polyester crystalline resin or from about 0.1 to about 0.3 weight percent of the toner composition solids.

23. A process comprising mixing an amorphous polyester resin, a crystalline polyester resin containing a salt of a rosin acid represented by at least one of the following formulas/structures

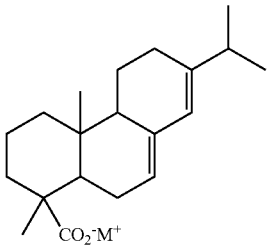

Abietic Acid

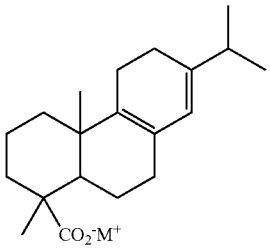

Palustric Acid

-continued

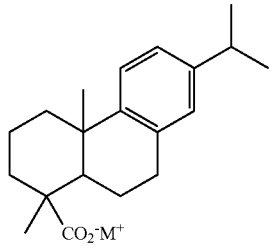

Dehydroabietic Acid

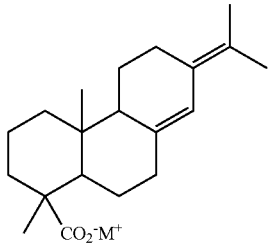

Neo-Abietic Acid

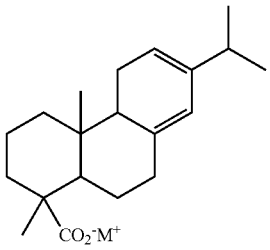

Levo-Pimaric Acid

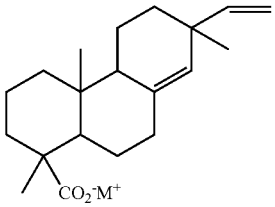

Pimaric Acid

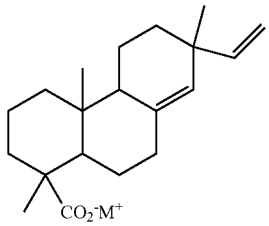

Sandaracopimaric Acid

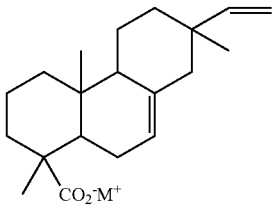

Iso-Pimaric Acid a colorant, and wax, and aggregating and coalescing to form toner particles, and wherein M is a hydrogen atom, NH4 or a metal.

24. A process in accordance with to claim 23 wherein said salt of a rosin acid is added in an amount of from about 0.01 percent to about 10 percent by weight of the crystalline resin, and wherein the toner has a toner cohesion of from about 1 percent to about 40 percent, and optionally wherein the aggregating is accomplished below about the glass transition temperature of the resin mixture, and the coalescence is accomplished at about above the glass transition temperature of the resin mixture, and optionally wherein the aggregating temperature is from about 35° C. to about 45° C., and the coalescence temperature is from about 75° C. to about 90° C.

* * * * *